US006209809B1

(12) United States Patent
Mariutti

(10) Patent No.: US 6,209,809 B1
(45) Date of Patent: Apr. 3, 2001

(54) GRINDING BARRELS FOR PULVERIZERS

(76) Inventor: Tony Mariutti, 8560 Baxter Place, Burnaby, British Columbia (CA), V5A 4T2

( * ) Notice: Subject to any disclaimer, the term of this patent is extended or adjusted under 35 U.S.C. 154(b) by 0 days.

(21) Appl. No.: 09/335,604

(22) Filed: Jun. 18, 1999

(51) Int. Cl.[7] ..... B02C 19/00
(52) U.S. Cl. ..... 241/30; 241/84.3; 241/199.1
(58) Field of Search ..... 241/84.3, 30, 266, 241/175, 199.1

(56) References Cited

U.S. PATENT DOCUMENTS 4,640,468 * 2/1987 Quinn ..... 241/199.1
5,556,044 * 9/1996 Hobson ..... 241/175

FOREIGN PATENT DOCUMENTS 173072 3/1986 (EP) .

* cited by examiner

*Primary Examiner*—Mark Rosenbaum
(74) *Attorney, Agent, or Firm*—Milde, Hoffberg & Macklin, LLP

(57) ABSTRACT

A grinding barrel has a grinding barrel body with a peripheral wall and a bottom wall, the peripheral wall defining an open top, a grinding barrel lid closing the open top and a grinding disk in the hollow interior of the barrel. The bottom wall has an upper surface, the grinding disk has a downwardly facing undersurface, and the upper surface and the undersurface are formed with mutually interengaged recessed and protruding surface portions shaped to allow the grinding disk to slide across the upwardly facing surface to the peripheral wall and to interfit with one another along a line of contact at central surface portions of the and the bottom wall and also at the periphery of the disk, thereby improving the grinding efficiency of the grinding barrel.

15 Claims, 8 Drawing Sheets

GRINDING BARRELS FOR PULVERIZERS

BACKGROUND OF THE INVENTION

1. Field of the Invention

The present invention relates to grinding barrels for use in pulverizers and to methods of grinding material.

2. Description of the Related Art

For the purpose of assaying core samples obtained by drilling, the core samples are normally firstly broken into pieces and these pieces are then pulverized in a pulverizer.

More particularly, the pulverizer is provided with a grinding barrel comprising an upwardly open, dish-shaped grinding barrel body provided with a circular lid for closing the top of the grinding barrel body and a grinding disk located in the interior of the grinding barrel body. The grinding disk has a peripheral diameter which is less than the internal diameter of the grinding barrel body.

In use, the broken pieces or core material are placed in the interior of the grinding barrel body, together with the grinding disk, and the lid is then fitted onto the grinding barrel body. The assembly of the lid, the grinding barrel body and the grinding barrel disk are then installed in the pulverizer, which rotates the assembly with a circular motion, thus causing the grinding disk to slide around within the grinding barrel body, and the bottom of the grinding barrel, so that the material to be pulverized is crushed and pulverized between the grinding disk and the internal surface of the grinding barrel body.

In conventional grinding barrels, the grinding barrel body has a flat circular bottom surface, and the grinding disk has a flat circular undersurface which slides across the top surface of the bottom of the grinding barrel body. Consequently, the material is pulverized mainly between the peripheral surface of the grinding disk and the annular wall of the grinding barrel body.

SUMMARY OF THE INVENTION

According to the present invention, there is provided a grinding barrel which has a grinding barrel body formed with an annular peripheral wall and a bottom wall, the annular peripheral wall defining an open top, and grinding barrel lid for closing the open top. The grinding barrel body contains a grinding disk, and an undersurface of the grinding disk, and an upper surface of a bottom of the grinding barrel body, are formed with mutually interengaged recessed and protruding portions.

Preferably, the grinding disk and the grinding barrel body are dimensioned so that the disk is displaceable across the upper surface to the peripheral wall of the grinding barrel body at any side of the grinding barrel, and so that the recessed and protruding surface portions are then brought together at an opposite side of the grinding barrel. Consequently, the material is ground between the disk and the barrel both at the periphery of the disk and an internal surface of the peripheral wall and, also, between the recessed and surface portions of the disk and the bottom wall of the grinding barrel body.

In a preferred embodiment of the present invention, the recessed and protruding surface portions comprise a central convexly curved protruding portion of the upper surface of the bottom wall of the grinding barrel body and a central, concavely curved recessed portion of the undersurface of the grinding disk.

Also according to the present invention, a method of grinding material in a grinding barrel between a grinding barrel body and a grinding disk within the grinding barrel comprises oscillating the grinding barrel body to displace the grinding disk across the grinding barrel body and thereby grinding the material simultaneously between a peripheral portion of the grinding disk and the grinding barrel body and also between a recess in a central portion of the underside of the grinding disk and a raised central portion of a bottom wall of the grinding barrel body protruding loosely into the recess.

BRIEF DESCRIPTION OF THE DRAWINGS

The invention will be more readily apparent from the following description of embodiments that are given, by way of example, with reference to the accompanying drawings, in which.

DESCRIPTION OF THE PREFERRED EMBODIMENT

Figure 1:
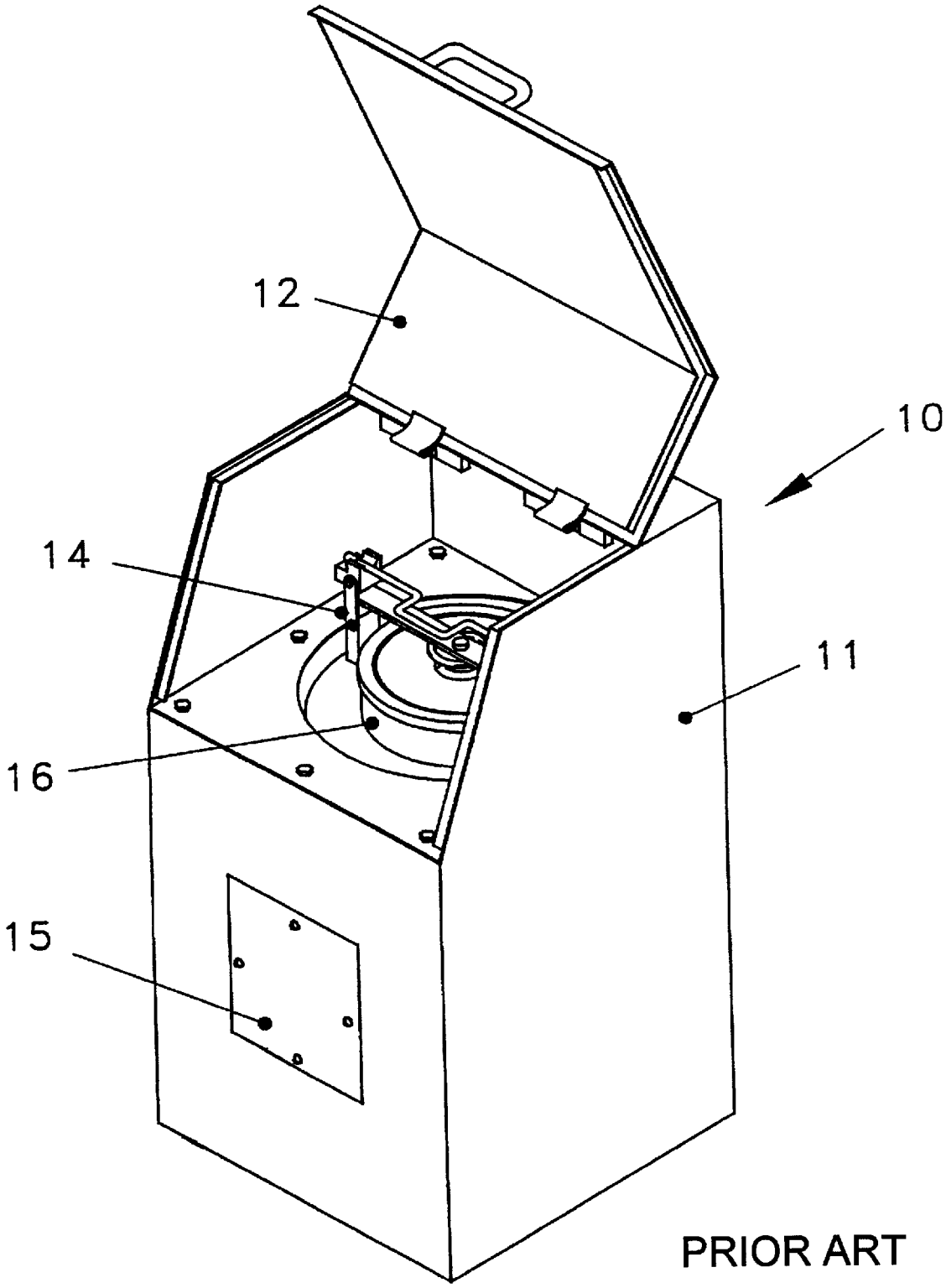
FIG. 1 shows a view in perspective of a pulverizer.

In FIG. 1 of the accompanying drawings, there is shown a pulverizer indicated generally by reference numeral 10. The pulverizer 10 has a housing 11 provided, at its top, a lid 12 which is shown in an open position in FIG. 1 so as to reveal, within the pulverizer 10, a clamp 14, which is shown clamping a grinding barrel, indicated generally by reference numeral 16. The front of the housing 11 includes an access door 15. Also, the grinding barrel 16 is a conventional grinding barrel having a flat bottomed, cylindrical shape and containing a flat bottomed circular grinding disk (not shown). On energization of the motor of the pulverizer 10, the clamp 14 and therewith the grinding barrel 16 are oscillated to displace the grinding disk so as to grind material between the grinding disk and the interior surface of the grinding barrel in a manner well know to those skilled in the art.

As will be familiar to those skilled in the art, the pulverizer 10 contains an electric motor (not shown) which is employed to oscillate the grinding barrel 16 for the purpose of pulverizing and/or mixing materials contained with the grinding barrel 16.

Figure 2:
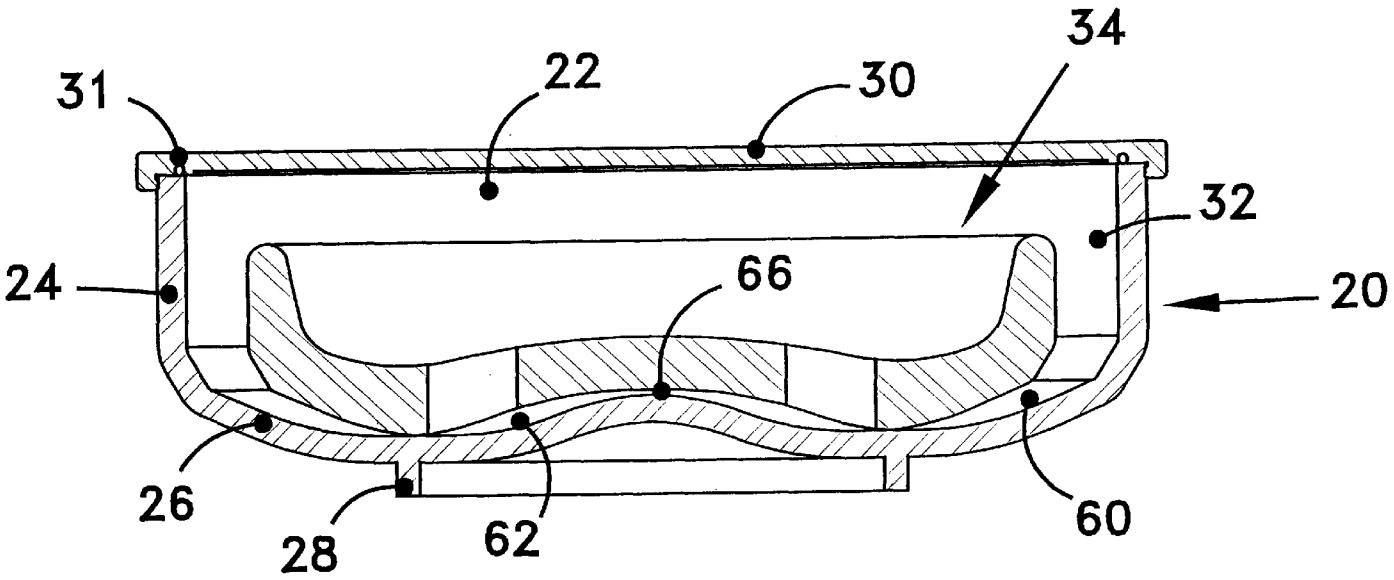
FIGS. 2 and 3 show views taken in vertical cross-section through a grinding barrel according to a first embodiment of the invention.
Figure 3:
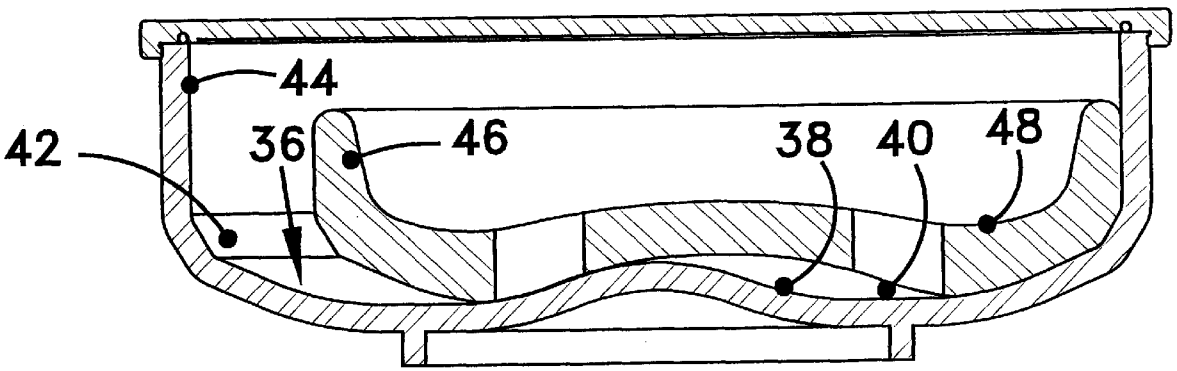

In FIGS. 2 and 3 of the accompanying drawings, reference numeral 20 indicates generally a grinding barrel 20 according to the present invention for use in the pulverizer 10 in place of the prior art grinding barrel 16.

More particularly, as shown in FIGS. 2 and 3 the grinding barrel 20 comprises a grinding barrel body 22 which is of upwardly-open dish-shaped configuration with a cylindrical peripheral wall 24 extending upwardly from a bottom wall 26. The bottom wall 26 is provided with a downwardly projecting annular flange 28 forming a support for the grinding barrel 20.

The top of the grinding barrel body 22 is closed by a circular lid 30, which is sealed to the top of the peripheral wall 24 by a sealing ring 31 recessed n the lid 30. The grinding barrel body 22 and the lid 30 together define a hollow interior 32, which contains a grinding disk indicated generally by reference numeral 34.

The bottom wall 26 of the grinding barrel body 22 has, at its uppermost face, an upper surface indicated generally by reference numeral 36, which comprises a central, convexly curved upwardly protruding or raised surface portion 38, on an upwardly protruding central portion of the bottom wall 26, and an annular surface portion 40 extending around and merging smoothly with the central portion 38. The annular surface portion extends to a frusto-conical surface 42 which, in turn, extends to a cylindrical inner surface 44 of the peripheral wall 24 of the grinding barrel body 22.

The grinding disk 34, which is radially outwardly displaceable by sliding over the bottom wall 26 to the peripheral wall 24, is also of upwardly-open dish-shaped configuration, and has a peripheral wall 46 extending upwardly from a bottom 48. The bottom 48 of the grinding disk 34 has, at its lowermost face opposed to the uppermost face of the bottom wall 26, an undersurface, indicated generally by reference numeral 50, which comprises a central, concavely curved, downwardly facing recessed surface portion 52 forming a recess or downwardly facing recessed portion of the grinding disk 34 and an annular surface portion 54, on a downwardly facing annular portion of the grinding disk 34, extending around and merging smoothly with the central surface portion 52. The annular surface portion 54 extends to a frusto-conical surface 56 which, in turn, extends to a cylindrical outer peripheral surface 58.

The peripheral surface 58 of the grinding disk 34 has an outer diameter which is less than the diameter of the inner surface 44 of the cylindrical peripheral wall 24 of the grinding barrel body 22.

The annular surface portion 40 of the surface 36, the frusto-conical surface 42 and the inner surface 44 of the grinding barrel body 22 together form an outer or first annular grinding surface which has a concave cross-sectional shape complementary to that of a first or outer annular grinding surface formed on the grinding disk 34 by the annular surface portion 58 of the undersurface 50, the frusto-conical surface 56 and the peripheral surface 58.

The convex central surface portion 38 forms, on the protruding central portion of the bottom wall 26, an inner or second grinding surface which has a cross-sectional shape complementary to an inner or second grinding surface formed by the recessed central surface portion 52 on the recessed portion of the grinding disk 34.

In a rest position, in which it is shown in FIG. 1, and which corresponds to the state of the grinding barrel 20 when the pulverizer 10 is switched off, the grinding disk 34 is disposed centrally with respect to the grinding barrel body 22 and these two components are dimensioned so that a gap 60 is provided between the grinding disk 34 and the grinding barrel body 22 around the entire periphery of the grinding disk 34, and a further gap 62 is provided between the central raised and recessed surface portions 38 and 52. The raised central portion 38 therefore fits loosely into the recessed central portion 52.

When the grinding barrel 20 is in use, and is being oscillated in the pulverizer, the grinding disk 34 is displaced by centrifugal force towards the position, relative to the grinding barrel body 22, in which it is illustrated in FIG. 3. Consequently, at the right hand side of the grinding disk 34, as illustrated in FIG. 3, the grinding disk 34 fits snugly against the grinding disk body 22 along a line of contact.

Furthermore, at the side of the grinding disk 34 remote from this side, the outer annular grinding surfaces of the central raised and recessed portions 38 and 52, also interfit snugly along a line of contact with one another.

Therefore, when the grinding barrel 20 is in use, the material to be pulverized is ground between the outer grinding surfaces and also, simultaneously, between the inner grinding surfaces.

Figure 4:
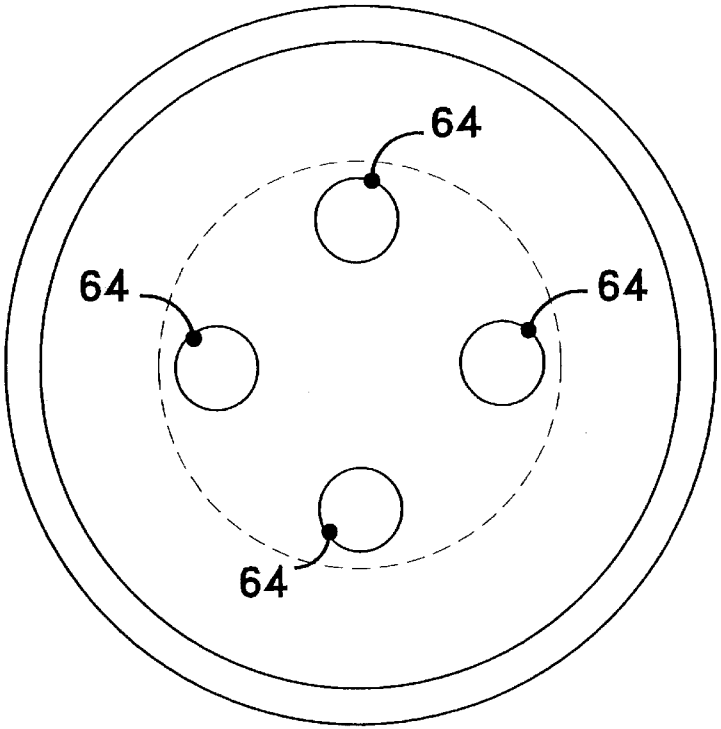
FIGS. 4 and 5 show a plan view and a view in vertical cross-section, respectively, of a grinding disk forming part of the grinding barrel of FIGS. 2 and 3.

The grinding disk 34 is also provided with through openings 64, which are equiangularly distributed about the center of the disk 34, to allow the material to be ground to flow through the grinding disk 34 during the grinding operation. As seen in FIG. 4, in the present embodiment four of these through openings 64 are provided in the grinding disk 34. These through openings 64 are of vertical cylindrical shape.

Figure 5:
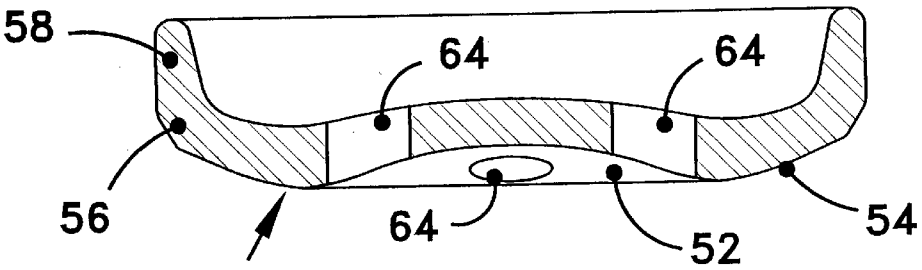
Figure 6:
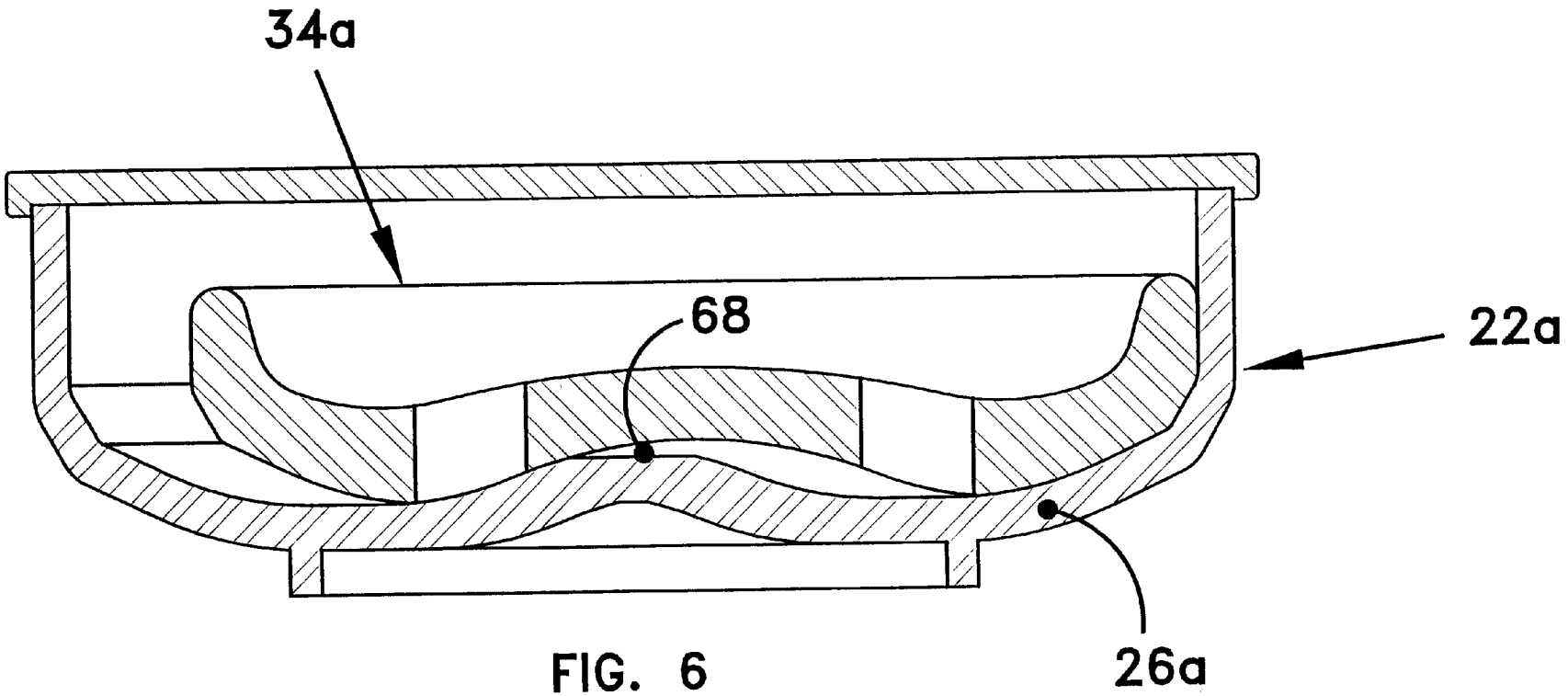
FIG. 6 shows a view taken in vertical cross-section through a first modification of the grinding barrel of FIGS. 2 and 3.

Various modifications may be made to the above-described embodiment of the present invention. For example, the central raised portion 38 as illustrated in FIGS. 2 and 3 has a smoothly convexly curved crown 66. In a modification of the grinding disk 34 indicated generally by reference numeral 34*a* in FIG. 6, the smoothly curved crown 66 is replaced by a flat circular crown 66. By comparison of FIGS. 2, 3 and 5, on one hand, and FIG. 6, on the other hand, it will be seen that the shape, including the thickness of the bottom 26 of the grinding barrel body indicated generally by reference numeral 20*a* in FIG. 6 has been modified from that of the bottom 48 shown in FIGS. 2, 3 and 5. Likewise, in FIG. 6 there is shown a grinding disk 34*a* which is similar to the grinding disk 34 of FIGS. 2 through 5 but has a somewhat greater thickness.

Figure 7:
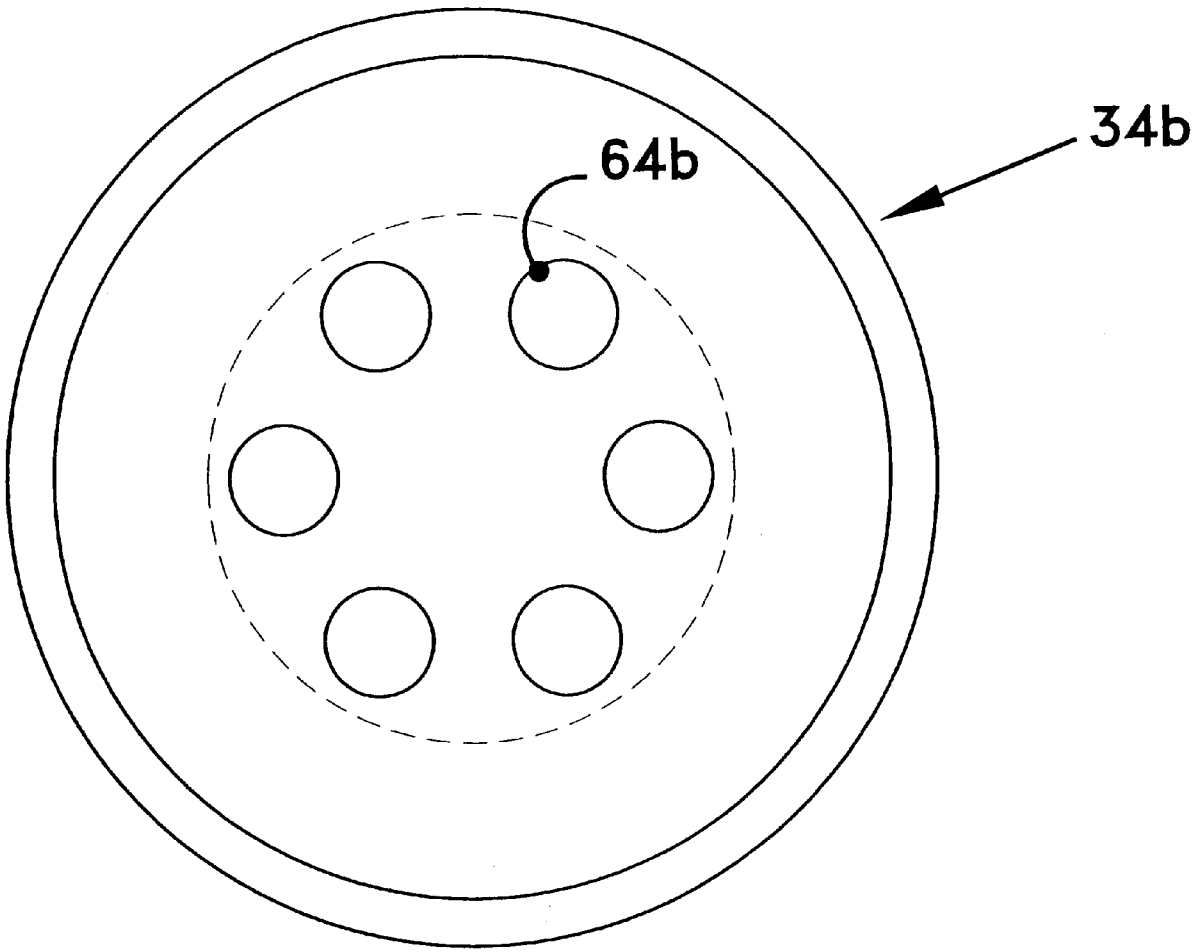
FIG. 7 shows a plan view of a modification of the grinding disk of FIGS. 2 through 5.

While the grinding disk 34 as shown in FIG. 4 is provided with four through openings 64, it is to be understood that the number of these through openings 64 may be varied and, by way of example, FIG. 7 shows a modified grinding disk 34*b* provided with six through openings 64*b*.

Figure 8:
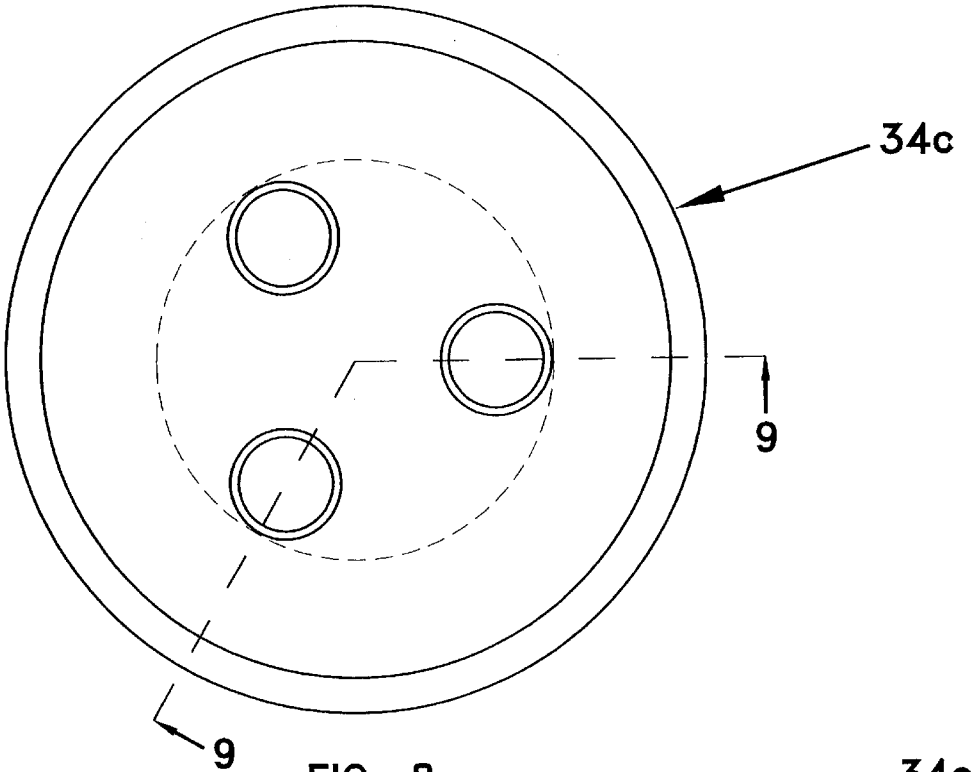
FIG. 8 shows a plan view of a further modification of the grinding disk of FIGS. 2 through 5.
Figure 9:
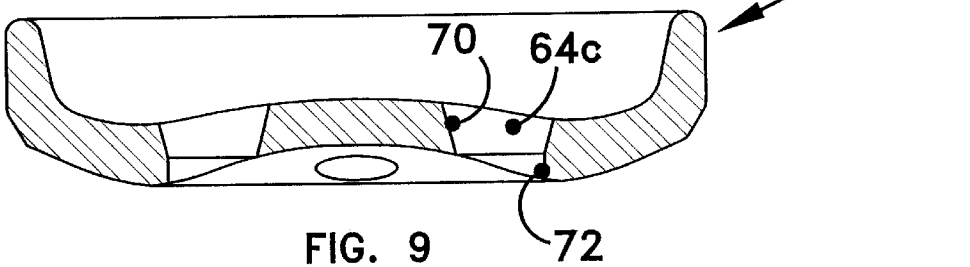
FIG. 9 shows a view taken in cross-section along the line 9—9 of FIG. 8.

Furthermore, while the shapes of the through openings 64 shown in FIGS. 2 through 5 are cylindrical, the invention is not restricted to this shape and, as shown by way of example in FIGS. 8 and 9, which show a modified grinding disk indicated generally by reference numeral 34*c*, the cylindrical through openings 64 and 64*b* may be replaced by through openings 64*c* each having a frusto-conical upper portion 70 and a cylindrical lower portion 72. It will also be observed that the grinding disk 34*c* shown in FIGS. 7 and 8 is provided with only three through openings 64*c*.

Figure 10:
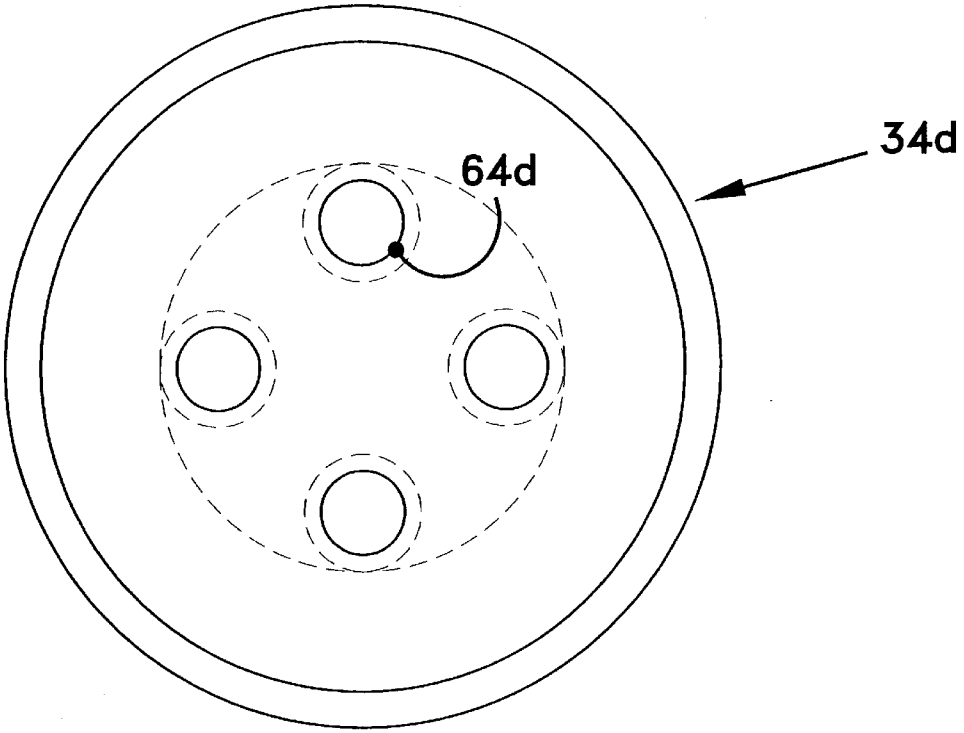
FIGS. 10 and 11 show a plan view, and a view in vertical cross-section, respectively, of a still further modification of the grinding disk of FIGS. 2 through 5.
Figure 11:
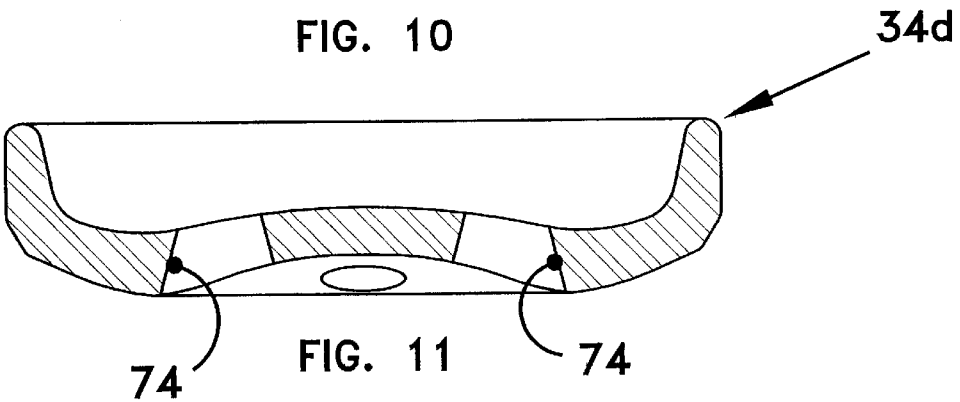

FIGS. 10 and 11 show a still further modification of the grinding disk, indicated generally by reference numeral 34*d*. This grinding disk 34*d* has four through openings 64*d* which are defined by upwardly convergent frusto-conical surfaces 74.

Figure 12:
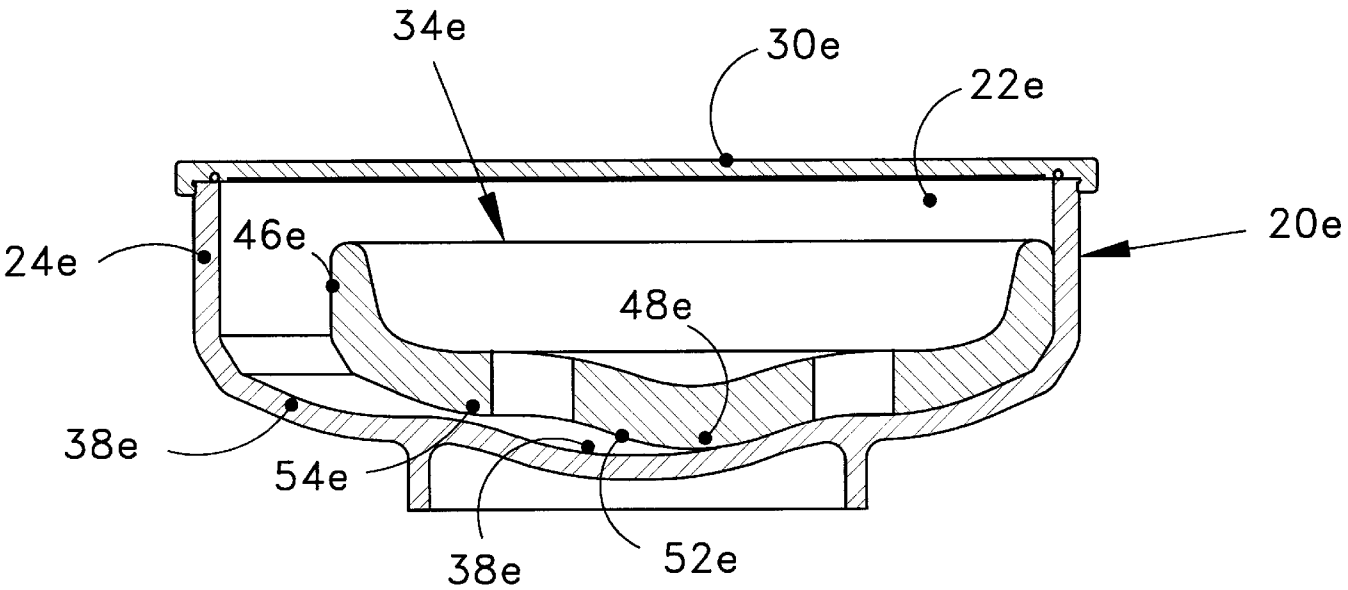
FIGS. 12 and 13 show views taken in vertical cross-section through a yet further modification of the grinding barrel of FIG. 1.
Figure 13:
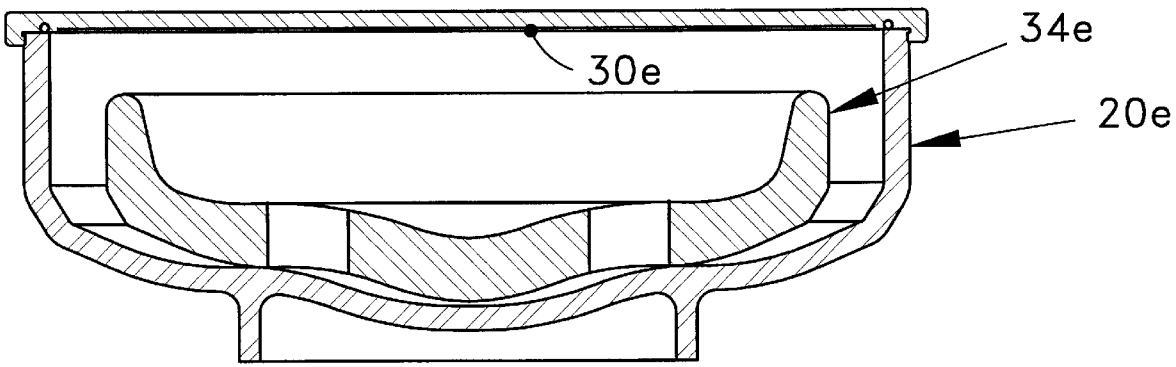

In FIGS. 12 and 13, there is shown a grinding barrel, indicated generally by reference numeral 20*e*, comprising a grinding barrel body 22*e* provided with a lid 30*e* similar to the lid 30 of FIG. 1 and also containing a grinding disk, indicated generally by reference numeral 34*e*, in which the center of the underside of the grinding disk 34*e* is downwardly convex and the center of the upper surface of the bottom of the grinding barrel body 22*e* is upwardly concave.

More particularly, the grinding barrel body 22*e* has a peripheral wall 24*e* and a bottom wall 38*e*, which has a central, convexly curved, upwardly facing, recessed surface portion 38*e*.

The grinding disk 34*e* has a peripheral wall 46*e* and a bottom 48*e*, which is formed, at its lowermost face or undersurface opposed to the uppermost surface of the bottom wall 38*e*, with a central, convexly curved, downwardly facing protruding surface portion 52*e* forming a downwardly protruding portion of the bottom 48*e*. The undersurface of the bottom 48*e* also includes an annular surface portion 54*e* of ogival cross-section extending around and merging smoothly with the central surface portion 52*e*.

As shown in FIG. 12, when the grinding disk 34*e* is displaced radially to bring the peripheral wall 46*e* of the grinding disk 34*e* against the peripheral wall 24*e* of the grinding barrel body 22*e*, the grinding disk 34*e* and the grinding barrel body 22*e* interfit snugly along a line of contact extending across one side of each of the central surface portions 38*e* and 52*e* and also across the annular surface portion 54*e* and part of the peripheral wall 46*e* of the grinding disk 34*e*.

As will be apparent to those skilled in the art, various other modifications may be made within the scope of the appended claims.

I claim:

1. A grinding barrel, comprising a grinding barrel body;

said grinding barrel body having a peripheral wall and a bottom wall;

said peripheral wall defining an open top; and a grinding barrel lid closing said open top;

said lid, said bottom wall and said peripheral wall defining a hollow interior; and a grinding disk in said hollow interior;

said bottom wall having an upper surface, said grinding disk having a downwardly facing undersurface, and said upper surface and said undersurface being formed with mutually interengaged recessed and protruding surface portions shaped to allow said grinding disk to slide across said upwardly facing surface to said peripheral wall.

2. A grinding barrel as claimed in claim 1, wherein said recessed and protruding surface portions comprise a central convexly curved protruding portion of said upper surface of said bottom wall and a central concavely curved recessed portion of said undersurface.

3. A grinding barrel, comprising a grinding barrel body;

said grinding barrel body having a peripheral wall and a bottom wall;

said peripheral wall defining an open top; and a grinding barrel lid closing said open top;

said lid, said bottom wall and said peripheral wall defining a hollow interior; and a grinding disk in said hollow interior;

said bottom wall having an upwardly protruding central portion and an annular portion extending around said raised central portion;

said grinding disk having a downwardly facing recessed central portion and a downwardly facing annular portion extending around said recessed central portion; and said disk being slidable across said bottom wall to said peripheral wall.

4. A grinding barrel as claimed in claim 3, wherein said protruding central portion and said recessed central portion have grinding surfaces with complimentary cross-sectional shapes.

5. A grinding barrel as claimed in claim 4, wherein said peripheral wall has an inner surface, said bottom having an upper surface and said upper surface and said inner surface merging at a first grinding surface, said grinding disk has an annular peripheral surface and an undersurface, said undersurface and said annular peripheral surface merging at a second grinding surface, and said first and second grinding surfaces having complimentary cross-sectional shapes.

6. A grinding barrel, comprising a grinding barrel body;

said grinding barrel body having a cylindrical peripheral wall and a bottom wall;

said peripheral wall defining an open top; and a grinding barrel lid closing said open top;

said lid, said bottom wall and said peripheral wall defining a hollow interior; and a grinding disk in said hollow interior, said grinding disk having a peripheral diameter less than the inner diameter of said peripheral wall;

said bottom wall having an upper surface, and said upper surface having a raised central surface portion, and an annular portion extending around said raised central portion, and said grinding disk having an undersurface and said undersurface having a central recessed circular surface portion and an annular portion extending around said recessed central circular portion;

said grinding barrel having inner and outer internal annular grinding surfaces; and said grinding disk having inner and outer external annular grinding surfaces which are complimentary in cross-sectional shape to said inner and outer internal annular grinding surfaces of said grinding barrel body;

whereby on displacement of said grinding disk radially outwardly to said peripheral wall said inner grinding surfaces fit snugly against one another along a line of contact and said outer grinding surfaces simultaneously fit snugly against one another along another line of contact so that, in use, material is simultaneously ground between said inner and outer grinding surfaces.

7. A grinding barrel, comprising a grinding barrel body;

said grinding barrel body having a peripheral wall and a bottom wall;

said peripheral wall having a cylindrical inner surface and defining an open top; and a grinding barrel lid closing said open top;

said lid, said bottom wall and said peripheral wall defining a hollow interior; and a grinding disk in said hollow interior, said grinding disk having a peripheral surface and said peripheral surface having a diameter less than that of said inner surface of said peripheral wall;

said grinding disk and said grinding barrel body having opposed faces;

a recess in one of said opposed faces;

a protruding portion on the other of said opposed faces, said protruding portion extending into said recess;

said recess and said protruding portion having inner grinding surfaces of complementary cross-sectional shapes;

said peripheral surface and said inner surface forming portions of annular outer grinding surfaces having complimentary cross-sectional shapes; and said inner and outer grinding surfaces being simultaneously in snug contact along respective lines of contact on displacement of said grinding disk across said bottom wall to said peripheral wall.

8. A grinding barrel as claimed in claim 7, wherein said annular outer grinding surface of said grinding barrel body comprises adjacent portions of said inner peripheral surface and said face of said grinding barrel body and said outer grinding surface of said grinding disk comprise a peripheral surface of said disk and a portion of said face of said grinding disk.

9. A grinding barrel as claimed in claim 7, wherein said protruding portion comprises a convexly curved central portion of said bottom wall and said recess comprises a concavely curved central portion of said grinding disk.

10. A grinding barrel as claimed in claim 8, wherein said protruding portion comprises a convexly curved central portion of said bottom wall and said recess comprises a concavely curved central portion of said grinding disk.

11. A grinding barrel as claimed in claim 7, wherein said peripheral surface of said grinding disk and said inner surface of said peripheral wall are cylindrical.

12. A grinding barrel as claimed in claim 7, including a plurality of through openings extending vertically through said grinding disk, said through openings being equiangularly distributed around said central portion of said grinding disk.

13. A grinding barrel as claimed in claim 7, wherein said grinding disk is dish-shaped with an upwardly extending peripheral wall.

14. A grinding barrel as claimed in claim 9, wherein said grinding disk has an upwardly concave annular portion extending around said central portion of said grinding disk and an annular peripheral wall extending upwardly from said annular portion.

15. A method of grinding material in a grinding barrel between a grinding barrel body and a grinding disk within said grinding barrel body, which comprises:

oscillating said grinding barrel body to displace said grinding disk across said grinding barrel body and thereby grinding the material simultaneously between a peripheral portion of said grinding disk and the grinding barrel body and also between a recess in a central portion of the underside of said grinding disk and a raised central portion of a bottom wall of said grinding barrel body protruding loosely into said recess.

* * * * *